US007516916B2

(12) United States Patent
Titz et al.

(10) Patent No.: US 7,516,916 B2
(45) Date of Patent: Apr. 14, 2009

(54) METHOD FOR SPLICING MATERIAL WEBS AND SPLICING DEVICE

(75) Inventors: Felix Titz, Weiherhammer (DE); Wolfgang Janner, Mantel (DE)

(73) Assignee: BHS Corrugated Maschinen-und Anlagenbau GmbH, Weiherhammer (DE)

( * ) Notice: Subject to any disclaimer, the term of this patent is extended or adjusted under 35 U.S.C. 154(b) by 157 days.

(21) Appl. No.: 11/625,407

(22) Filed: Jan. 22, 2007

(65) Prior Publication Data

US 2007/0170300 A1 Jul. 26, 2007

(30) Foreign Application Priority Data

Jan. 24, 2006 (DE) ..... 10 2006 003 200

(51) Int. Cl.
*B65H 21/00* (2006.01)

(52) U.S. Cl. ..... 242/553; 242/555.6; 242/556.1

(58) Field of Classification Search ..... 242/553, 242/556.1, 526.3, 555.6
See application file for complete search history.

(56) References Cited

U.S. PATENT DOCUMENTS

| | | | | |
|---|---|---|---|---|
| 4,892,611 | A | 1/1990 | Wheeler et al. | |
| 5,014,924 | A * | 5/1991 | Nowisch et al. | 242/526.3 |
| 5,252,170 | A * | 10/1993 | Schaupp | 156/350 |
| 5,472,755 | A | 12/1995 | Nibling, Jr. | |
| 6,582,547 | B1 | 6/2003 | Gebbekken et al. | |
| 7,087,278 | B2 | 8/2006 | Eikmeier et al. | |
| 2005/0056719 | A1 | 3/2005 | Tafel | |

FOREIGN PATENT DOCUMENTS

| | | | |
|---|---|---|---|
| CA | 2039631 | 2/2000 | |
| CA | 2303506 | 9/2000 | |
| DE | 4033900 | 10/1991 | |
| GB | 1 231 767 | 5/1971 | |
| JP | 63-127961 | 11/1986 | |
| JP | 3-115044 | 5/1991 | |
| JP | 06009118 A * | 1/1994 | 242/555.6 |

OTHER PUBLICATIONS

Search report for German Priority Document 10 2006 003 200.4.
European Search Report of Corresponding European Application.
English Abstract of DE 3504688.
English Translation of Claim 1 of German Utility Model 29500653.
English Translation of Claim 1 of German Patent 2101116.
English Abstract of DE 102004028312.

* cited by examiner

*Primary Examiner*—Sang Kim
(74) *Attorney, Agent, or Firm*—James B. Conte

(57) ABSTRACT

In a method for splicing material webs and an associated splicing device it is envisaged, for producing an improved joint, to join the material webs in the area of cut edges essentially overlap-free to form an endless material web, the cut edges being produced by cutting the material webs at least along a first cutting direction and along a second cutting direction, and the cutting directions enclosing an angle $\alpha$ such that $0° < \alpha < 180°$ applies.

33 Claims, 4 Drawing Sheets

METHOD FOR SPLICING MATERIAL WEBS AND SPLICING DEVICE

BACKGROUND OF THE INVENTION

1. Field of the Invention

The invention relates to a method for splicing material webs, particularly paper webs for manufacturing a corrugated cardboard web in a corrugated cardboard plant, and an associated splicing device.

2. Background Art

Known splicing devices join an ending first material web with a new second material web such that an endless material web results. In technical language this process is referred to as splicing, and a corresponding device is referred to as a splicing device.

A known method for splicing material webs envisages that the material webs to be joined are arranged partly on top of one another, with a double-sided adhesive tape being affixed between the material webs. This method has the disadvantage that in the joining area of the material webs there occurs a doubling of material, which causes considerable problems during further processing of the endless material web produced. Another known method for splicing material webs envisages that the material webs to be joined are arranged edge against edge on a one-sided adhesive tape. While this method avoids a doubling of the material in the joining area, the endless material web produced does not exhibit a sufficient stiffness in the joining area because the joining area acts as a kind of hinge. The lack of stiffness also leads to considerable problems during further processing of the endless material web in the corrugated cardboard plant.

SUMMARY OF THE INVENTION

The invention is based on the object of creating a method and a splicing device for splicing material webs, which allow a simple joining of the material webs that is unproblematic for a further processing of the material webs.

Said object is achieved by a method for splicing material webs, comprising the following steps: unrolling of a first material web from a first material roll; producing of a first cut edge by cutting a second material web at least along a first cutting direction and along a second cutting direction, the cutting directions enclosing an angle $\alpha$ such that $0°<\alpha<180°$ applies; producing of a second cut edge complementary to the first cut edge by cutting the first material web at least along the first cutting direction and along the second cutting direction; joining of the first material web with the second material web in the area of the cut edges to form an endless material web, the first material web and the second material web being arranged relative to each other essentially overlap-free; and unrolling of the second material web from a second material roll. Said object is also achieved by a splicing device for the splicing of material webs, having a first unrolling device for unrolling a first material web from a first material roll, a second unrolling device for unrolling a second material web from a second material roll, and at least one cutting and joining device for the cutting and joining of the material webs to form an endless material web, wherein the cutting and joining device exhibits at least one first cutting section running along a first cutting direction, the cutting and joining device exhibits at least one second cutting section running along a second cutting direction, and the cutting directions enclose an angle $\alpha$ such that $0°<\alpha<180°$ applies. The core of the invention consists in that cut edges are produced on the material webs prior to the joining of the material webs to form an endless material web, with the cut edges essentially complementing one another without a gap to form the endless material web. Said cut edges are produced by cutting the material webs at least along a first cutting direction and along a second cutting direction, said cutting directions enclosing an angle $\alpha$ such that $0°<\alpha<180°$ applies. When the material webs are joined, they are arranged relative to each other essentially overlap-free and without a gap so that a doubling of the material and, because the cut edges are profiled and formed complementarily to each other, a hinge effect are avoided. To produce the cut edges, the splicing device exhibits at least one cutting and joining device with cutting sections running along cutting directions.

Additional features and details result from the following description of several embodiments based on the drawings.

DESCRIPTION OF THE PREFERRED EMBODIMENTS

Figure 1:
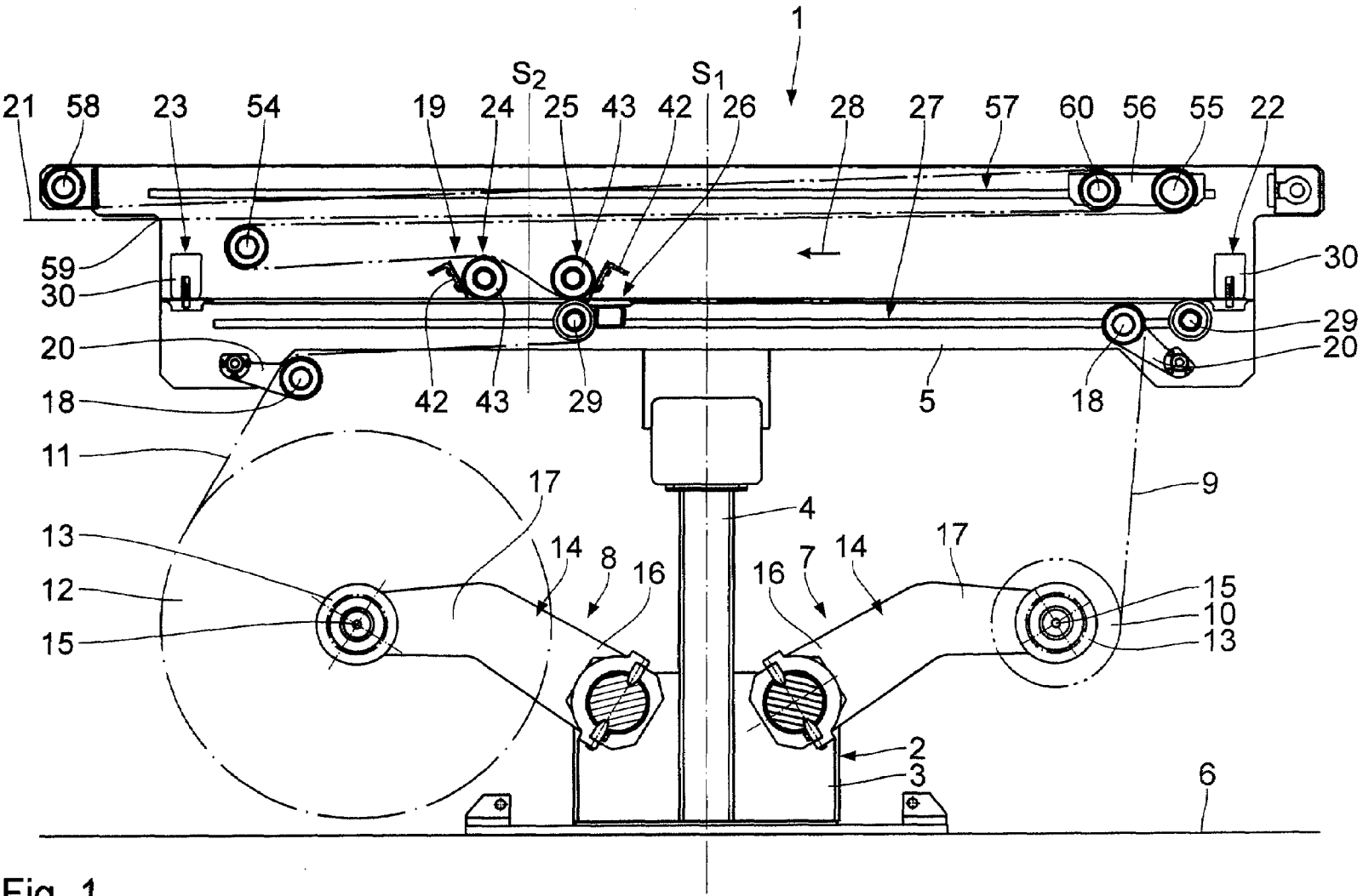
FIG. 1 shows a schematic side view of a splicing device according to a first embodiment example.

In the following, a first embodiment of the present invention is described with reference to FIGS. 1 to 5. A splicing device 1 exhibits a base frame 2 having a base frame pedestal 3, a base frame column 4 and a base frame carrier 5. The base frame pedestal 3 is attached to the floor 6. On the base frame pedestal 3 there is attached the base frame column 4, with the latter extending essentially vertically to the floor 6. The base frame carrier 5 is attached to an end of the base frame column 4 that is located on the opposite side of the base frame pedestal 3 and extends essentially parallel to the floor 6.

Proceeding from the base frame pedestal 3 there extend a first unrolling device 7 and a second unrolling device 8, which are swingably mounted on the base frame pedestal 3 and arranged opposite to each other relative to the base frame column 4. The first unrolling device 7 serves to unroll a first material web 9 from a first material roll 10, whereas the second unrolling device 8 serves to unroll a second material web 11 from a second material roll 12.

To receive the first material roll 10, the first unrolling device 7 exhibits a receiving roller 13, which is guided through a central opening of the first material roll 10 and rotatably arranged around a rotational axis 15 between two holding arms 14 running parallel to each other. The holding arms 14 each exhibit a first holding arm section 16 running inclined to the floor 6 and attached to the base frame pedestal 3, and a second holding arm section 17 formed onto said first holding arm section 16 as a single part and running essentially parallel to the floor 6, the receiving roller 13 being arranged on a free end of the second holding arm section 17 lying opposite of the first holding arm section 16. The second unrolling device 8 is designed in accordance with the first unrolling device 7, with the rotational axes 15 of the unrolling devices 7, 8 running parallel to each other.

The material webs 9, 11 are each fed to a cutting and joining device 19 via a feeder roller 18. The feeder rollers 18 are rotatably attached to roller arms 20, swingably mounted on the base frame carrier 5 near the material rolls 10, 12 for tightening the material webs 9, 11.

The cutting and joining device 19 serves to produce an endless material web 21 from the finite material webs 9, 11. In the following, the first material web 9 and/or the second material web 11 downstream of the cutting and joining device 19 are referred to as an endless material web 21.

To cut the material webs 9, 11 and to join said material webs to form the endless material web 21, the cutting and joining device 19 exhibits a first preparation unit 22, a second preparation unit 23, a first joining unit 24, a second joining unit 25, a table unit 26 and a guide 27. The first preparation unit 22 is mounted on the base frame carrier 5 in the area of the first material roll 10, whereas the second preparation unit 23 is mounted on the base frame carrier 5 in the area of the second material roll 12. Between the preparation units 22, 23 there runs the guide 27 essentially parallel to the floor 6, the table unit 26 in the guide 27 being displaceable between the preparation units 22, 23 along a first displacement direction 28. The joining units 24, 25 are spaced along the first displacement direction 28 between the preparation units 22, 23 and are arranged, relative to the guide 27, to lie opposite to the base frame column 4 on the base frame carrier 5.

Figure 2:
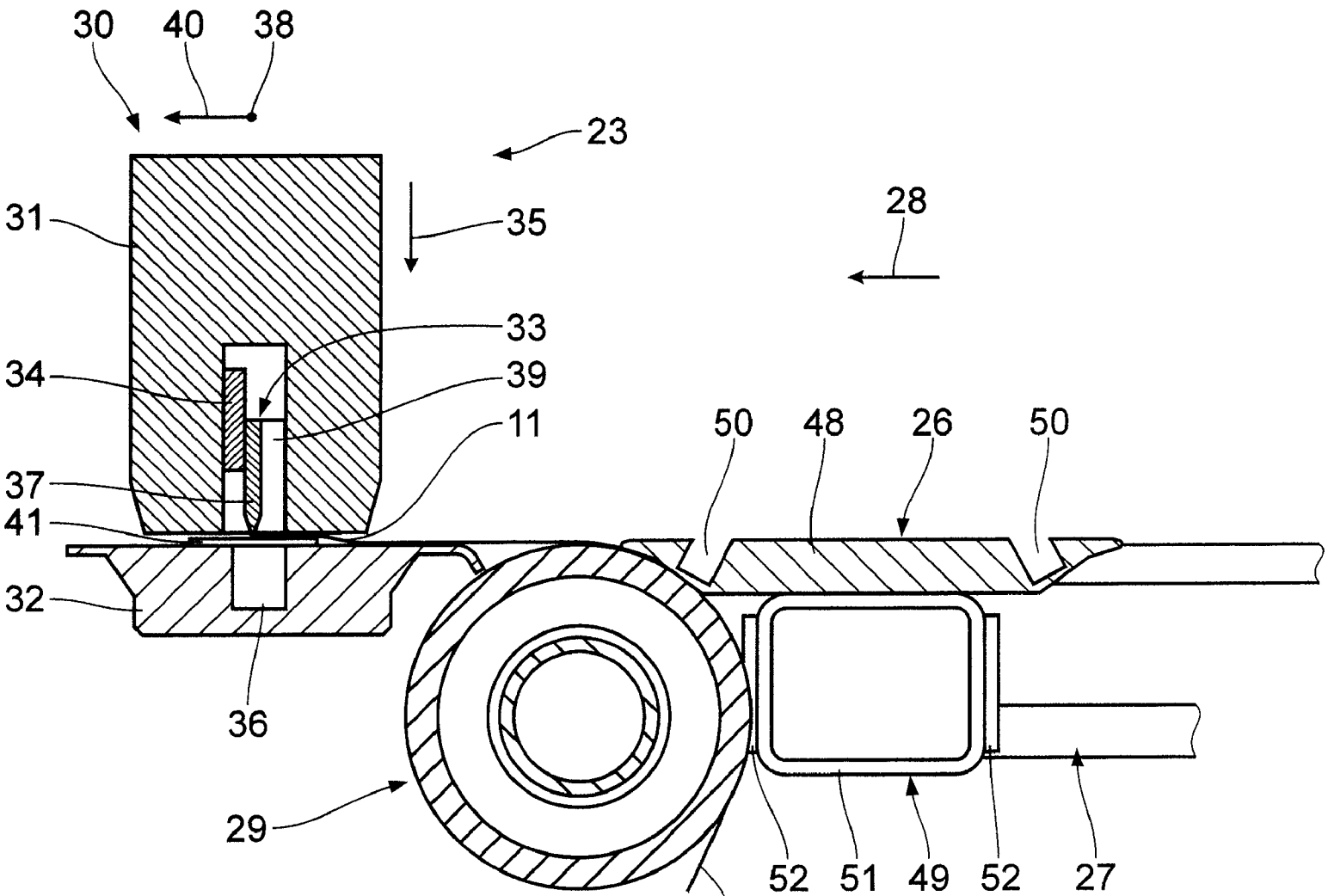
FIG. 2 shows a first detail of a cutting and joining device of the splicing device in FIG. 1.

The preparation units 22, 23 are designed identically and are symmetrically arranged on the base frame carrier 5 relative to a symmetry plane $S_1$ running vertically to the first displacement direction 28 through the base frame column 4. Given the identical design of the preparation units 22, 23 only one preparation unit 22, 23 is described below. In FIG. 2 there is shown, for example, the second preparation unit 23, the table unit 26 being displaced in the guide 27 along the first displacement direction 28 such that the table unit 26 is arranged in the immediate vicinity of the second preparation unit 23.

The second preparation unit 23 exhibits a bonding roller 29, arranged on the base frame carrier 5 to be rotatably drivable, for feeding the second material web 11, and a first cross cutter 30 for cutting the fed second material web 11. The first cross cutter 30 comprises a cross cutter housing 31 and a cross cutter support 32 arranged relative to the second material web 11 opposite the cross cutter housing 31. Inside the cross cutter housing 31 there is arranged a first knife bar 33, which is affixed to a first knife bar carrier 34 and is displaceable along a second displacement direction 35 extending essentially vertically to the first displacement direction 28. The cross cutter support 32 is designed as a table and, for the feeding of the second material web 11 in the area of the bonding roller 29, bent towards thereto. To receive the first knife bar 33 during the cutting of the second material web 11, the cross cutter support 32 exhibits a support groove 36 running along the first knife bar 33.

The first knife bar 33 exhibits a plurality of first cutting sections 37 running along a first cutting direction 38. Furthermore, the first knife bar 33 exhibits a plurality of second cutting sections 39, running along a second cutting direction 40, with cutting directions 38, 40 enclosing an angle $\alpha$ of 90°. The cutting sections 37, 39 are alternately arranged along the first knife bar 33, with in each case two neighbouring first cutting sections 37 being spaced along the second cutting direction 40 and being arranged parallel to each other, and in each case two neighbouring second cutting sections 39 being spaced along the first cutting direction 38 and being arranged parallel to each other.

The bonding roller 29 is provided with an adhesive layer for the feeding of the second material web 11 and is displaceable along the first displacement direction 28 in the guide 27 for transporting the second material web 11 from the first cross cutter 30 to the second joining unit 25. For attaching a single-sided adhesive tape 41, the second preparation unit 23 also comprises a feed unit not shown in FIG. 2, having a vacuum pump. The vacuum pump is connected with the cross cutter housing 31 to generate a vacuum pressure in the area between the cross cutter housing 31 and the cross cutter support 32.

Figure 3:
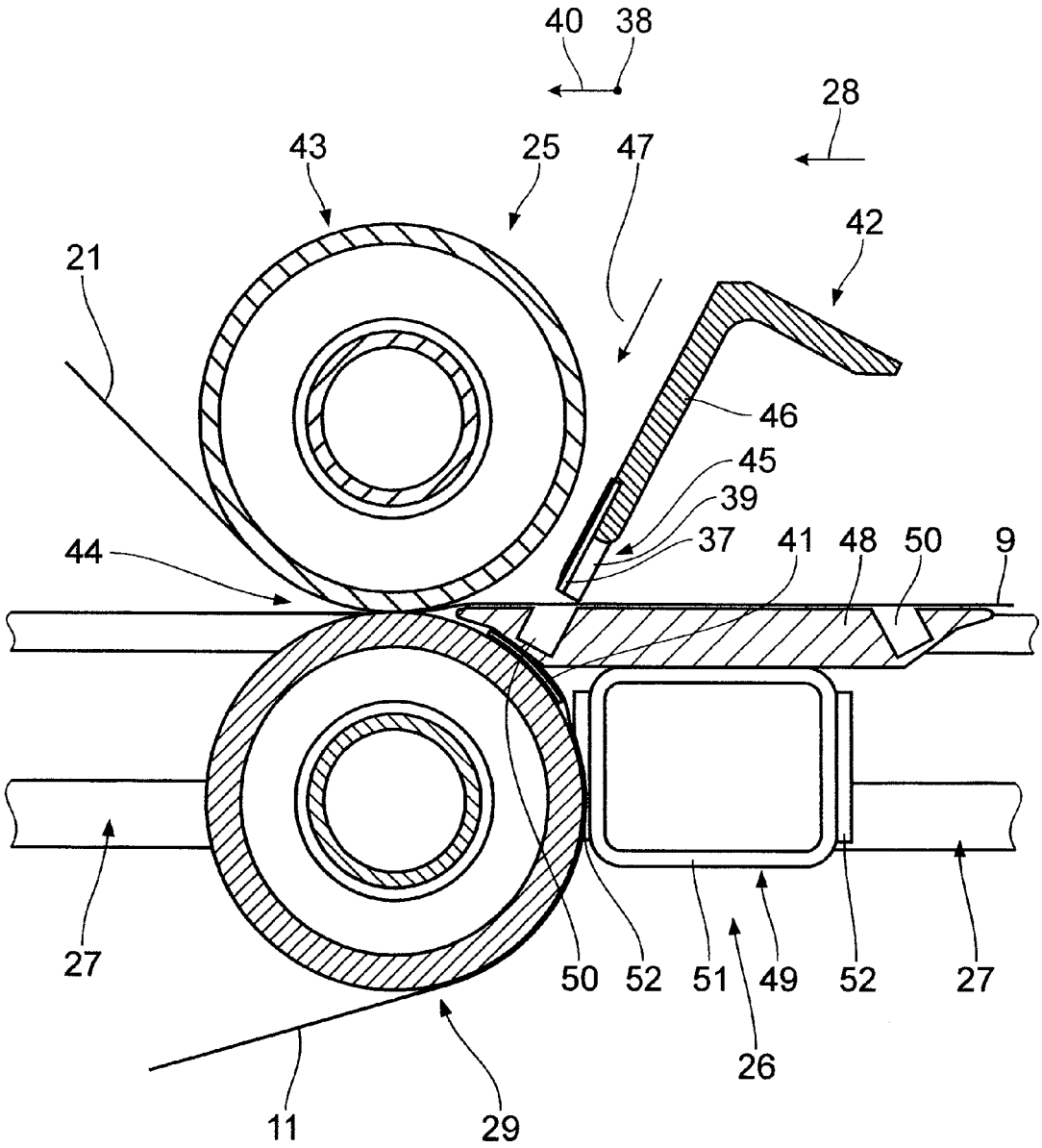
FIG. 3 shows a second detail of the cutting and joining device of the splicing device in FIG. 1.
Figure 4:
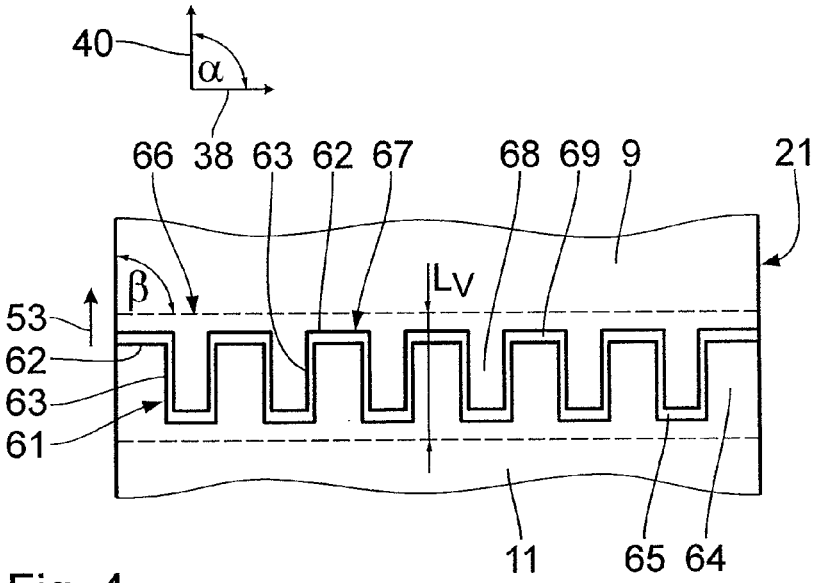
FIG. 4 shows a top view onto a joining area of an endless material web produced by means of the splicing device in FIG. 1.
Figure 5:
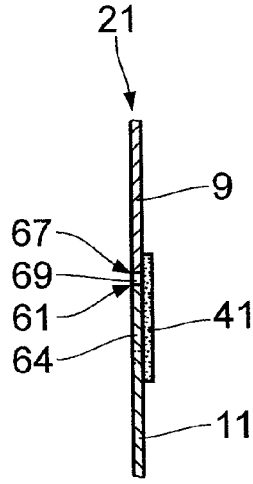
FIG. 5 shows a cross-section of the endless material web in FIG. 4.

The joining units 24, 25 are identically designed and are symmetrically arranged on the base frame carrier 5 relative to a symmetry plane $S_2$ running vertically to the first displacement direction 28 and centrally between the joining units 24, 25. Given their identical design, only one joining unit 24, 25 is described below. In FIG. 3, for example, the second joining unit 25 is shown, with the table unit 26 and the bonding roller 29 of the second preparation unit 23 being displaced in the guide 27 along the first displacement direction 28 so as to be arranged in the immediate vicinity of the second joining unit 25. The second joining unit 25 comprises a second cross cutter 42 for cutting the first material web 9 prior to joining with the second material web 11, and a press-on roller 43 for joining the material webs 9, 11 to form the endless material web 21. The second cross cutter 42 and the press-on roller 43 are mounted on the base frame carrier 5 in the immediate vicinity of the guide 27 so that the bonding rollers 29 of preparation units 22, 23 and the table unit 26 in the guide 27 can be guided past the second joining unit 25. In the position of the bonding roller 29 shown in FIG. 3, the press-on roller 43 forms a joining gap 44 therewith for guiding through the material webs 9, 11 to be joined and the adhesive tape 41.

The second cross cutter 42 exhibits a second knife bar 45 extending at a right angle to the material web 9, said second knife bar 45 being attached to a second knife bar carrier 46 and being displaceable along a third displacement direction 47. The second knife bar 45 exhibits, correspondingly to the first knife bar 33, a plurality of first cutting sections 37, running along a first cutting direction 38, and a plurality of second cutting sections 39, running along a second cutting direction 40. The cutting sections 37, 39 running along the cutting directions 38, 40 enclose an angle $\alpha$ of 90°, with in each case two neighbouring first cutting sections 37 being spaced along the second cutting direction 40 and being arranged parallel to each other, and in each case two neighbouring first second cutting sections 39 being spaced along the first cutting direction 38 and being arranged parallel to each other.

As an alternative to the knife bars 33, 45, the cross cutters 30, 42 can also exhibit other cutting tools, such as, for example, a laser beam, said cutting tools exhibiting at least one first cutting section and at least one second cutting section or being guided alongside thereto.

The table unit 26 acts together with the preparation units 22, 23 and/or with the joining units 24, 25 and is displaceable, independent therefrom, in the guide 27 along the first displacement direction 28. FIG. 2 shows the table unit 26 acting together with the second preparation unit 23 in a first position, whereas FIG. 3 shows the table unit 26 acting together with the second joining unit 25 and the bonding roller 29 of the second preparation unit 23 in a second position. The table unit 26 comprises a table 48 running along the first displacement direction 28, and a press-on component 49 attached thereto. On the side facing the bonding rollers 29, the table 48 is bent in accordance with the radius of the bonding rollers 29. In addition, the table 48 exhibits two table grooves 50 spaced apart along the first displacement direction 28, which extend along the third displacement direction 47 to receive the second knife bar 45 of the joining units 24, 25. The press-on component 49 is arranged, relative to the table 48, opposite the joining units 24, 25 and exhibits a press-on frame 51 and two elastically formed press-on buffers 52 arranged opposite relative to the press-on frame 51 and facing the bonding rollers 29.

In a transportation direction 53 of the endless material web 21 there is positioned, downstream of the cutting and joining device 19, a first deflection roller 54, which is rotatably arranged on the base frame carrier 5 in the area of the second preparation unit 23. In the transportation direction 53 there is positioned, downstream of the first deflection roller 54, a second deflection roller 55, which is rotatably arranged on a slide 56. The slide 56 is positioned in the area of a base frame carrier 5 end lying opposite the base frame column 4, the slide 56 being displaceable along the first displacement direction 28 in a slide guide 57 running parallel to the guide 27. The slide guide 57 extends essentially along the entire base frame carrier 5, the slide 56 being displaceable between a first slide end position and second slide end position.

In the transportation direction 53 there is positioned, downstream of the second deflection roller 55, a third deflection roller 58, which is rotatably arranged on the base frame carrier 5 in the area of a run-out 59 of material web 21. In the first slide end position the slide 56 faces the third deflection roller 58, whereas in the second slide end position the slide 56 faces away from the third deflection roller 58. FIG. 1 shows the slide 56 in the second slide end position.

In the transportation direction 53 there is positioned, downstream of the third deflection roller 58, a fourth deflection roller 60, which is rotatably arranged on the slide 56 between the second deflection roller 55 and the third deflection roller 58. In comparison to the second deflection roller 55 the fourth deflection roller 60 exhibits a smaller roller diameter.

The table unit 26, the bonding rollers 29 and slide 56 are displaceable by means of drive devices not shown in greater detail, said drive devices being controlled by a control device also not shown in greater detail.

In the following, the functioning of the splicing device 1 is described. The first material web 9 is unrolled from the first material roll 10 and guided via the feeder roller 18 through the press-on rollers 43 of the joining units 24, 25. The bonding roller 29 of the first preparation unit 22 is located—as shown in FIG. 1—in the vicinity of the first cross cutter 30 of the first preparation unit 22. The table unit 26 and the bonding roller 29 of the second preparation unit 23 are first in the position shown in FIG. 2. Downstream of the joining units 24, 25 the first material web 9, which is referred to as an endless material web 21, is deflected by 180° by means of the first deflection roller 54 and guided to the second deflection roller 55 where the endless material web 21 is again deflected by 180°. The slide 56 is initially located—as shown in FIG. 1—in the second slide end position. Downstream of the second deflection roller 55 the endless material web 21 is guided to the third deflection roller 58 where the endless material web 21 is deflected by 180° and returned to the fourth deflection roller 60. As the fourth deflection roller 60 has a roller diameter that is smaller in comparison to the second deflection roller 55, the endless material web 21 can again be deflected by 180° without touching itself and be guided to the run-out 59 where the endless material web 21 leaves the splicing device 1 for manufacturing corrugated cardboard.

Because of the constant unrolling of the first material web 9, the first material roll 10 ends after a certain time so that the second material web 11 needs to be joined with the first material web 9. To this end the second material web 11 is first fed manually or automatically via the feeder roller 18 to the bonding roller 29 of the second preparation unit 23. By turning the bonding roller 29 the second material web 11 is fed to the first cross cutter 30, the second material web 11 being arranged between the cross cutter support 32 and the first knife bar 33. To hold the second material web 11 in this position, the table unit 26 is displaced in the first displacement direction 28 so that one of the press-on buffers 52 lies against the second material web 11, pressing it against the bonding roller 29.

To produce a first cut edge 61, the first knife bar 33 is displaced into the second displacement direction 35 so that the second material web 11 is fully severed. When severing the second material web 11, the first knife bar 33 plunges into the support groove 36 of the cross cutter support 32. After the severing of the second material web 11 the first knife bar 33 is displaced back opposite to the second displacement direction 35 into the starting position.

Owing to the first and second cutting sections 37, 39 of the first knife bar 33, the first cut edge 61 exhibits first partial cut edges 62, running along the first cutting direction 38, and second partial cut edges 63, running along the second cutting direction 40. In accordance with the cutting directions 37, 39, the partial cut edges 62, 63 enclose an angle $\alpha$ of 90°. As the partial cut edges 62, 63 run in different cutting directions 38, 40, the first cut edge 61 is profiled and exhibits first cut edge projections 64 and first cut edge recesses 65, forming a positive profile of the first cut edge 61. The first cut edge projections 64 and the first cut edge recesses 65 are of a rectangular or square shape.

After the making of the first cut edge 61 there is fed, by means of the feed unit, the single-sided adhesive tape 41 and arranged between the second material web 11 and the cross cutter support 32 in the area of the first cut edge projections 64 and the first cut edge recesses 65, the second material web 11 being lifted by means of the vacuum pump during the feeding. The adhesive tape 41 defines a joining area 66 and fully covers the first cut edge projections 64 and the first cut edge recesses 65.

After the attaching of the adhesive tape 41 the table unit 26 releases the second material web 11. By turning the bonding roller 29 the second material web 11 is removed from out of the first cross cutter 30, the turning of the bonding roller 29 continuing until the adhesive tape 41 comes to lie on the bonding roller 29 in an area facing the table unit 26. Afterwards the second material web 11 is again pressed against the bonding roller 29 by means of the table unit 26 and the table unit 26, together with the bonding roller 29 and the second material web 11, is displaced in the guide 27 towards the second joining unit 25 against the first displacement direction 28. This condition is shown in FIG. 3.

Because of the known length of the first material web 9 the splicing device 1 detects when the first material roll 10 ends. Before this occurs, the prepared second material web 11 is joined with the first material web 9. To this end, the unrolling of the first material web 9 is first decelerated and stopped, the loops formed by the material web 21 by means of the deflection rollers 54, 55, 58, 60 being undone by the displacement of the slide 56 from the second slide end position into the first slide end position, and the material web 21 continuing to leave the splicing device 1.

To join the material webs 9, 11, the first material web 9 is first fully severed by means of the second cross cutter 42 so that a second cut edge 67 is produced. To produce the second cut edge 67, the second knife bar 45 is displaced in the third displacement direction 47, the second knife bar 45 plunging into the associated table groove 50 of the table 48. After the severing of the first material web 9 the second knife bar 45 displaced back against the third displacement direction 47 into the staring position.

The second cut edge 67 exhibits, correspondingly to the first cutting sections 37 of the second knife bar 45, first partial cut edges 62 running along the first cutting direction 38, and, correspondingly to the second cutting sections 39 of the second knife bar 45, second partial cut edges 63 running along the second cutting direction 40. Because of the different cutting directions 38, 40, the second cut edge 67 is also profiled and exhibits second cut edge projections 68 and second cut edge recesses 69 that from a negative profile. The second cut edge projections 68 and the second cut edge recesses 69 are also of a rectangular or square shape.

The first cut edge 61 and the second cut edge 67 are formed complementary to each other and supplement each other essentially overlap-free and without a gap to form the endless material web 21. The positive profile of the first cut edge 61 supplements the negative profile of the second cut edge 67 in such a way that during the joining of the material webs 9, 11, the first cut edge projections 64 engage into the second cut edge recesses 69 and the second cut edge projections 68 engage into the first cut edge recesses 65. With their cut edge projections 64, 68 and the cut edge recesses 65, 69, the cut edges 61, 67 thus engage with each other in a finger-like way.

To join the material webs 9, 11, the table unit 26 releases the second material web 11 with the adhesive tape 41 and the material webs 9, 11 are guided by means of the bonding roller 29 and the press-on roller 43 through the joining gap 44 in such a way that the first material web 9 comes to lie on the part of the adhesive tape 41 not covered by the second material web 11 and is joined essentially overlap-free and without a gap with the second material web 11 to form the endless material web 21. The endless material web 21 produced thus exhibits the joining area 66, which is defined by the adhesive tape 41 and in which the material webs 9, 11 engage with each other along the transportation direction 53 in the manner described. The joining area 66 exhibits along the transportation direction 53 a length, $L_V$, of between 1 cm and 10 cm, particularly between 2 cm and 8 cm, and particularly between 3 cm and 6 cm. The first partial cut edges 62 run essentially vertical to the transportation direction 53 and the second partial cut edges 63 run essentially parallel to the transportation direction 53. Alternatively, the partial cut edges 62, 63 can also be pitched at any angle to the transportation direction 53 so that the joining area 66 runs inclined to the transportation direction 53 and is pitched at an angle β unequal to 90° to the transportation direction 53.

After the joining of the material webs 9, 11 the second material web 11 is unrolled from the second material roll 12. During the unrolling of the second material web 11 the slide 56 is displaced from the first slide end position into the second slide end position for the formation of loops of material web 21. Moreover, during the unrolling of the second material web 11, the bonding roller 29 of the second preparation unit 23 is displaced in the first displacement direction 28 and arranged in the area of the associated first cross cutter 30. Furthermore, a new first material roll 10 is arranged in the first unrolling device 7, and the table unit 26 is displaced against the first displacement direction 28 toward the first preparation unit 22 so that the new first material web 9 can be prepared for the joining with the second material web 11 in the manner already described. The cutting and the joining of the material webs 9, 11 now repeats itself.

Figure 6:
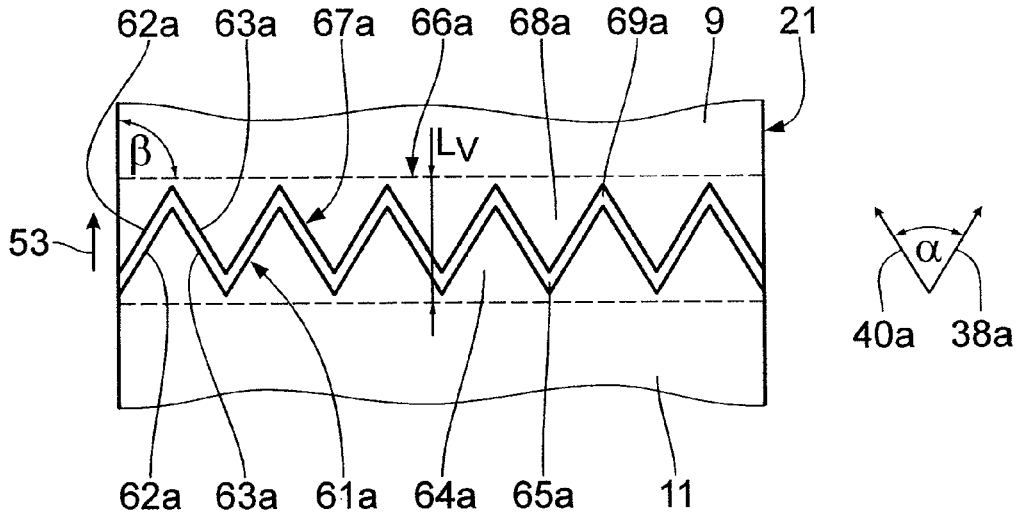
FIG. 6 shows a top view onto a joining area of an endless material web produced by means of a splicing device according to a second embodiment example.

In the following, a second embodiment of the invention is described with reference to FIG. 6. Components of an identical design receive the same reference numerals as in the first embodiment, to the description of which reference is hereby made. Functionally like components which are of a different design receive the same reference numerals followed by an 'a'. The main difference compared with the first embodiment consists in the forming of the cut edges 61*a*, 67*a* and the cut edge projections 64*a*, 68*a* and the cut edge recesses 65*a*, 69*a*. The cut edges 61*a*, 67*a* have a zigzag shape and, as a consequence, the cut edge projections 64*a*, 68*a* and the cut edge recesses 65*a*, 69*a* have a triangular shape. The cutting directions 38*a*, 40*a* enclose an angle α of less than 90°. The cutting directions 38*a*, 40*a* are pitched at an angle relative to the transportation direction 53, said angle being half of α. Alternatively, the cutting directions 38*a*, 40*a* can also be pitched at different angles relative to the transportation direction 53. The joining area 66*a* is essentially pitched at an angle of β unequal to 90° relative to the transportation direction 53. Alternatively, the joining area 66*a* can also be pitched at an angle of P unequal to 90° relative to the transportation direction 53. The partial cut edges 62*a*, 63*a* each exhibit the same length and are produced by cutting sections 37*a*, 39*a* running accordingly, which are not shown in greater detail.

Figure 7:
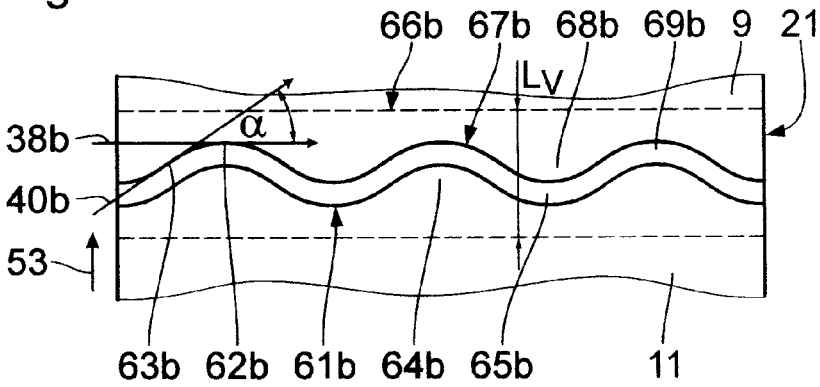
FIG. 7 shows a top view onto a joining area of an endless material web produced by means of a splicing device according to a third embodiment example.

In the following, a third embodiment of the invention is described with reference to FIG. 7. Components of an identical design receive the same reference numerals as in the first embodiment, to the description of which reference is hereby made. Functionally like components that are of a different design receive the same reference numerals followed by a 'b'. The main difference compared with the previous embodiments consists in the forming of the cut edges 61*b*, 67*b* and the cut edge projections 64*b*, 68*b* as well as the cut edge recesses 65*b*, 69*b*. The cut edges 61*b*, 67*b* and the cut edge projections 64*b*, 68*b* as well as the cut edge recesses 65*b*, 69*b* have a wave-like shape, with the production of cut edges 61*b*, 67*b*—seen mathematically—occurring by cutting the material webs 9, 11 along an endless number of cutting directions. As an example, there are drawn into FIG. 7 two cutting directions 38*b*, 40*b*, which—seen mathematically—are tangents of the cut edges 61*b*, 67*b* at individual points. The individual points constitute the partial cut edges 62*b*, 63*b*, which, in their totality, form the differentiable cut edges 61*b*, 67*b*. The cutting directions 38*b*, 40*b* drawn into FIG. 7 enclose approximately an angle α of 45°. The first cutting direction 38*b* runs essentially vertical relative to the transportation direction 53. The joining area 66*b* is pitched at an angle β of approximately 90° relative to the transportation direction 53. Alternatively, the joining area 66*b* can also be pitched at an angle β unequal to 90° to the transportation direction 53. The partial cut edges 62*b*, 63*b* correspond to cutting sections 37*b*, 39*b* running accordingly, which are not shown in more detail.

In principle, the cut edges can be shaped to have any profile as long as they are formed complementary to each other and the material webs 9, 11 supplement each other essentially overlap-free and without a gap to form the endless material web 21. The at least two cutting directions enclose an angle α such that $0° < \alpha < 180°$ applies. For the angle α of the cutting directions, particularly $30° \leqq \alpha \leqq 150°$, particularly $45° \leqq \alpha \leqq 135°$, and particularly $60° \leqq \alpha \leqq 120°$ applies. Due to the fact that the material webs 9, 11 engage with each other in the area of the cut edges essentially overlap-free and without a gap, there is avoided, on the one hand, a material doubling and, on the other hand, a hinge effect in the joining area.

What is claimed is:

1. Method for splicing material webs, comprising the following steps:

a. unrolling of a first material web from a first material roll;

b. reproducing of a first cut edge by cutting a second material web at least along a first cutting direction and along a second cutting direction, the cutting directions enclosing an angle $\alpha$ such that $0°<\alpha<180°$ applies;

c. producing of a second cut edge complementary to the first cut edge by cutting the first material web at least along the first cutting direction and along the second cutting direction;

d. joining of the first material web with the second material web in the area of the cut edges to form an endless material web, the first material web and the second material web being arranged relative to each other essentially overlap-free, i. wherein the first material web and the second material web engage into each other in a joining area along a transportation direction of the material webs and ii. wherein the cut edges each form several cut edge projections and several cut edge recesses; and e. unrolling of the second material web from a second material roll.

2. Method according to claim 1, wherein for the angle $\alpha$ of the cutting directions $30°\leqq\alpha\leqq150°$ applies.

3. Method according to claim 1, wherein for the angle $\alpha$ of the cutting directions $45°\leqq\alpha\leqq135°$ applies.

4. Method according to claim 1, wherein for the angle $\alpha$ of the cutting directions $60°\leqq\alpha\leqq120°$ applies.

5. Method according to claim 1, wherein the cut edge projections and the cut edge recesses have a rectangular or square shape.

6. Method according to claim 1, wherein the cut edge projections and the cut edge recesses have a triangular shape.

7. Method according to claim 1, wherein the cut edge projections and the cut edge recesses have a wave-like shape.

8. Method according to claim 1, wherein the joining takes place by means of a single-sided adhesive tape.

9. Method according to claim 1, wherein the joining area exhibits along the transportation direction a length of between 1 cm and 10 cm.

10. Method according to claim 1, wherein the joining area is pitched at an angle of 90° relative to the transportation direction.

11. Method according to claim 1, wherein the joining area is pitched at an angle unequal to 90° relative to the transportation direction.

12. Method according to claim 1, wherein the joining area is defined by an adhesive tape.

13. Splicing device for the splicing of material webs, having a. a first unrolling device for unrolling a first material web from first material roll, b. a second unrolling device for unrolling a second material web from a second material roll, and c. at least one cutting and joining device for the cutting and joining of the material webs to form an endless material web, wherein i. the cutting and joining device exhibits several first cutting sections running along a first cutting direction, ii. the cutting and joining device exhibits several second cutting sections running along a second cutting direction, iii. the cutting directions enclose an angle $\alpha$ such that $0°\leqq\alpha\leqq180°$ applies, and iv. the cutting sections are arranged such that a first cut edge is producible by cutting a second material web and a second cut edge complementary to the first cut edge is producible by cutting a first material web, the cut edges each form several cut edge projections and several cut edge recesses such that the first material web and the second material web engage into each other in a joining area along a transportation direction of the material webs.

14. Splicing device according to claim 13, wherein the cutting sections are formed on at least one knife bar.

15. Splicing device according to claim 13, wherein the cutting sections are formed such that the joining area exhibits along the transportation direction a length of between 1 cm and 10 cm.

16. Splicing device according to claim 13, wherein the cutting sections are arranged such that the joining area is pitched at an angle of 90° relative to the transportation direction.

17. Splicing device according to claim 13, wherein the cutting sections are arranged such that the joining area is pitched at an angle unequal to 90° relative to the transportation direction.

18. Splicing device according to claim 13, wherein the cutting and joining device comprises a first cross cutter with a first knife bar, the cutting sections being alternately arranged along the first knife bar, and a second cross cutter with a second knife bar, the cutting sections being arranged alternately along the second knife bar.

19. Splicing device according to claim 18, wherein the cutting and joining device comprises a bonding roller, the bonding roller being displaceable between the first cross cutter and the second cross cutter.

20. Splicing device according to claim 19, wherein the cutting and joining device comprises a table unit, the table unit being displaceable between the first cross cutter and the second cross cutter.

21. Splicing device according to claim 20, wherein the table unit comprises a press-on component with an elastically formed press-on buffer facing the bonding roller.

22. Method for splicing material webs, comprising the following steps:

a. unrolling of a first material web from a first material roll;

b. reproducing of a first cut edge by cutting a second material web at least along a first cutting direction and along a second cutting direction, the cutting directions enclosing an angle $\alpha$ such that $0°<\alpha<180°$ applies;

c. producing of a second cut edge complementary to the first cut edge by cutting the first material web at least along the first cutting direction and along the second cutting direction;

d. joining of the first material web with the second material web in the area of the cut edges to form an endless material web, the first material web and the second material web being arranged relative to each other essentially overlap-free, i. wherein the first material web and the second material web engage into each other in a joining area along a transportation direction of the material webs, ii. wherein the cut edges each form several cut edge projections and several cut edge recesses and iii. wherein the cut edge projections and the cut edge recesses have a wave-like shape; and e. unrolling of the second material web from a second material roll.

23. Method according to claim 22, wherein the joining takes place by means of a single-sided adhesive tape.

24. Method according to claim 22, wherein the joining area exhibits along the transportation direction a length of between 1 cm and 10 cm.

25. Method according to claim 22, wherein the joining area is pitched at an angle of 90° relative to the transportation direction.

26. Method according to claim 22, wherein the joining area is pitched at an angle unequal to 90° relative to the transportation direction.

27. Method according to claim 22, wherein the joining area is defined by an adhesive tape.

28. Method for splicing material webs, comprising the following steps:

a. unrolling of a first material web from a first material roll;

b. reproducing of a first cut edge by cutting a second material web at least along a first cutting direction and along a second cutting direction, the cutting directions enclosing an angle $\alpha$ such that $0° < \alpha < 180°$ applies;

c. producing of a second cut edge complementary to the first cut edge by cutting the first material web at least along the first cutting direction and along the second cutting direction;

d. joining of the first material web with the second material web in the area of the cut edges to form an endless material web, the first material web and the second material web being arranged relative to each other essentially overlap-free, i. wherein the first material web and the second material web engage into each other in a joining area along a transportation direction of the material webs, ii. wherein the cut edges each form several cut edge projections and several cut edge recesses and iii. wherein the cut edge projections and the cut edge recesses have a rectangular shape; and e. unrolling of the second material web from a second material roll.

29. Method according to claim 28, wherein the joining takes place by means of a single-sided adhesive tape.

30. Method according to claim 28, wherein the joining area exhibits along the transportation direction a length of between 1 cm and 10 cm.

31. Method according to claim 28, wherein the joining area is pitched at an angle of 90° relative to the transportation direction.

32. Method according to claim 28, wherein the joining area is pitched at an angle unequal to 90° relative to the transportation direction.

33. Method according to claim 28, wherein the joining area is defined by an adhesive tape.

* * * * *